United States Patent [19]

Van Sickle

[11] Patent Number: 4,732,169

[45] Date of Patent: Mar. 22, 1988

[54] WAFFLE SPONGE PERM ROD

[75] Inventor: Jean Van Sickle, Vienna, W. Va.

[73] Assignee: Perm-Ez Inc., Orlando, Fla.

[21] Appl. No.: 930,260

[22] Filed: Nov. 14, 1986

[51] Int. Cl.[4] ..... A45D 2/00

[52] U.S. Cl. ..... 132/42 R; 132/40

[58] Field of Search ..... 132/39 R, 40, 41 R, 132/42 R, 41 C, 42 A, 43 R

[56] References Cited

U.S. PATENT DOCUMENTS

| | | | |
|---|---|---|---|
| 2,258,920 | 10/1941 | Yates | 132/41 C |
| 2,391,284 | 12/1945 | Weiss | 132/42 R |
| 3,461,884 | 8/1969 | Augusta | 132/42 R |
| 4,381,791 | 5/1983 | Van Sickle | 132/40 |

FOREIGN PATENT DOCUMENTS

| | | | |
|---|---|---|---|
| 1033585 | 7/1953 | France | 132/42 R |
| 1368924 | 6/1964 | France | 132/42 R |
| 6220 | of 1896 | United Kingdom | 132/43 R |

*Primary Examiner*—Gene Mancene
*Assistant Examiner*—J. Hakomaki
*Attorney, Agent, or Firm*—Birch, Stewart, Kolasch & Birch

[57] ABSTRACT

A permanent wave roller for use in providing a permanent wave to hair which includes a rod having a predetermined length and an outer surface upon which an individual's hair is to be rolled to form a curl. An elongated pressure element extends along the rod for applying pressure toward the outer surface of the rod for maintaining hair in a curl upon the rod. A pad is positioned on the outer surface of the rod. The pad extends substantially along the length of the rod and includes a waffle-like shape for enhancing the passage of a permanent solution to a curl and to prevent damage to an individual's hair. The pressure element may be an elastic cord having a first end removably affixed to one end of said rod and a second end removably affixed to a second end of said rod. The rod includes a central portion having a smaller diameter in relation to end portions of the rod. A first attaching member is provided for affixing a first end of the pressure element to a first end of the rod and a second attaching member is provided for affixing a second end of the pressure element to a second end of the rod.

13 Claims, 3 Drawing Figures

WAFFLE SPONGE PERM ROD

BACKGROUND OF THE INVENTION

1. Field of the Invention

The present invention relates to a permanent wave roller for use in providing a permanent wave to hair which includes a pad affixed to an elongated pressure element. The pad has a waffle-like shape for enhancing the passage of a permanent solution to a curl and to prevent damage to an individual's hair.

2. Description of Background Art

It is conventional to use a permanent wave roller when applying a permanent wave solution to an individual's hair. Normally, a strand of hair is separated and rolled onto a roller to produce a curl. A permanent wave solution is applied to the wave on the permanent wave roller. Heat and pressure are applied to the hair to impart a permanent wave thereto. A neutralizer is applied to the hair to reform the primary bonds to the new wave imparted by the permanent wave roller.

A number of theories are necessary to understand to comprehend the procedure utilized in administering a permanent wave to an individual's hair. Reference is made to U.S. Pat. No. 4,381,791 issued on May 3, 1983 to the same inventor as the present invention. Three steps must occur to provide a permanent wave to an individual's hair:

1. Open the primary bond (usually accomplished by a strong chemical curling lotion).

2. Shift the position of the open bond ends (usually accomplished by rolling the hair on a spindle or rod).

3. Reform the primary bonds in the new shifted position (usually accomplished by a reforming chemical called a neutralizer).

When pressure is applied to the hair positioned on a permanent wave roller, a crease is formed in the softened hair. Thereafter, when the neutralizer is applied to the hair, the hair is hardened and damage occurs along the creased portions. The creased portions are not acceptable and are a considerable drawback to conventional permanent wave roller techniques. The invention set forth in U.S. Pat. No. 4,381,791 overcomes the disadvantage of creasing which is caused by a permanent wave roller.

SUMMARY AND OBJECTS OF THE INVENTION

The present invention also is designed to overcome a problem in conventional permanent wave rollers by eliminating crease lines on the softened hair which is caused by the band holding the permanent wave roller to the curl in a strand of an individual's hair.

Another object of the present invention is to provide a waffle-like pad positioned between an elongated pressure element and an individual's hair which enhances the passage of a permanent solution to a curl disposed on a permanent wave roller.

Another object of the present invention is to provide a waffle-like pad which prevents damage to an individual's hair positioned on a permanent wave roller.

A further object of the present invention is to provide a permanent wave roller which includes slots at both end thereof. The slots maintain an elongated pressure element in a predetermined disposition relative to the permanent wave roller to prevent rotation of a pad disposed on the elongated pressure element.

Another object of the present invention is to provide a plurality of apertures in the permanent wave roller rod. The plurality of apertures are preferably shaped in the form of a diamond to permit a better flow of permanent solution without weakening the structure of the rod.

These and other objects of the present invention are accomplished by providing a rod having a central section of decreased diameter relative to the enlarged diameter end sections. An elongated pressure element extends along the rod for applying pressure toward an outer surface of the rod for maintaining hair in a curl upon the rod. A pad is positioned between the elongated pressure element and hair positioned on the outer surface of the rod. The pad extends substantially along the length of the rod and includes a waffle-like shape for enhancing the passage of a permanent solution to a curl and for preventing damage to an individual's hair. The pressure element is an elastic cord which is removably affixed to a first and second end of the rod. A stopper member is affixed to one end of the elastic cord and is removably disposed within a bore passing through the permanent wave roller rod.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
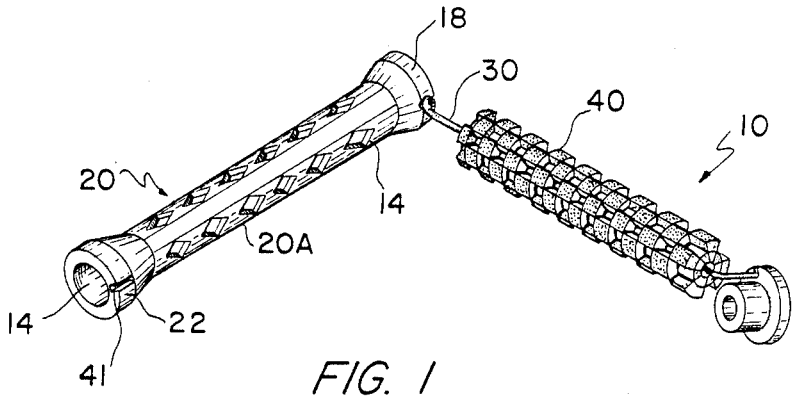
FIG. 1 is a perspective view illustrating the permanent wave roller rod of the present invention with one end of the elongated pressure element disengaged from the rod.
Figure 2:
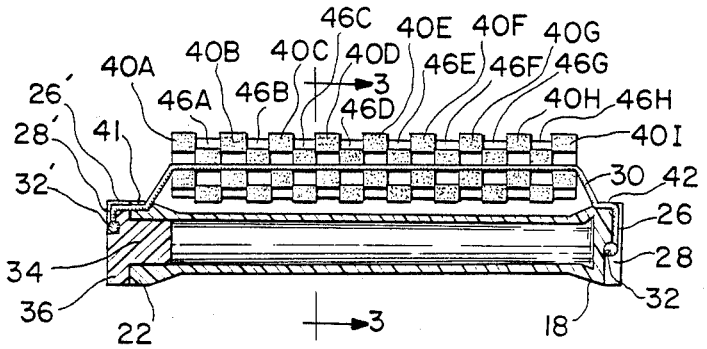
FIG. 2 is a partial cross-sectional view illustrating the connection of the elongated pressure element and pad to the rod.
Figure 3:
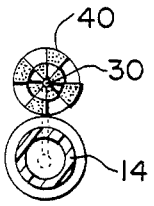
FIG. 3 is a cross-sectional view taken along line 3—3 of FIG. 2.

As illustrated in FIGS. 1–3, a permanent wave roller 10 includes a tubular rod 20, an elongated pressure element or elastic cord 30 and a pad or sponge element 40. The tubular rod 20 includes a central portion of reduced diameter 20A relative to the diameter of end portions 18, 22. An elongated pressure element 30 may be an elastic cord which is affixed to one end of the tubular rod 20 and extends along the length thereof and may be affixed to the end portion 22.

As illustrated in FIG. 2, the elastic cord 30 includes an enlarged end 32 which is received within a slot 28 and 26 in the end portion 18. The enlarged portion 32 is removably affixed within the slot 28 so as to secure the elongated pressure element for elastic cord 30 relative thereto. The other end of the elastic cord 30 includes an enlarged end 32'. The enlarged end 32' is received within slots 28' and 26' disposed in a stopper 34. The elastic cord 30 is removably affixed to the end 22 of the tubular rod 20. In this manner, a strand of an individual's hair may be curled upon the tubular rod 20 when the elastic cord 30 is disengaged therefrom. Thereafter, the elastic cord 30 may be secured to the end portion 22 to exert pressure for retaining the curl of hair on the tubular rod 20.

The stopper 34 includes an enlarged head 36. The enlarged head 36 engages the end portion 22 of the tubular rod 20. In addition, the slots 28' and 26' are disposed in the stopper 34. In addition, a slot 41 is disposed on the end portion 22 of the tubular rod 20. The slot 41 retains the elastic cord 30 in a predetermined disposition relative to the tubular rod 20. In addition, a slot 42 is formed in the end portion 18. In this manner, the slots 41 and 42 ensure that the elastic cord 30 is disposed in an accurate arrangement relative to the tubular rod 20.

As illustrated in FIG. 1, the tubular rod 20 includes a plurality of apertures 14 positioned therethrough. In addition, as illustrated in FIG. 2, a bore 14 extends along the length of the tubular rod 20. The plurality of apertures 14 may be any shape for producing the desired result. Diamond-shaped apertures have been found to produce satisfactory results. The diamond-shaped apertures permit permanent waving solution to flow through the tubular rod 20 and to impinge upon the curl of an individual's hair without weakening the structure of the tubular rod 20.

The pad member 40 may be constructed from a variety of various materials. Suitable materials include sponge, rubber, or plastic foam. The pad member 40 is a waffle-shaped element with a plurality of indentations therein. As illustrated in FIG. 2, the upper surface of the pad member 40 includes projecting pad portions 40A, 40B, 40C, 40D, 40E, 40F, 40G, 40H, and 40I. Similarly, indentations 46A, 46B, 46C, 46D, 46E, 46F, 46G, and 46H are provided between the projections 40A–40I. The series of projections and indentations permit the permanent wave solution to penetrate deep into the hair which is wrapped around the rod itself.

The pad 40 engages a strand of hair disposed on the tubular rod 20 to secure the strand of hair in a predetermined curl on the tubular rod 20. The pad 40 does not produce a crease in the hair. Thus, disadvantages of conventional permanent wave rollers are obviated. In addition, the waffle shape of the pad 40 produces improved results in permitting the permanent wave solution to penetrate deep into the hair. Further, the slots 41 and 42 retain the elongated pressure element 30 in a predetermined position relative to the tubular rod 20.

The elongated pressure element 30 may be constructed from a variety of various materials such as rubber or any other elastic material which will produce a force for pressuring the pad member 30 to impinge upon a curl of hair disposed on the tubular rod 20. Although a stopper 34 is illustrated in FIG. 2, a number of various connecting mechanisms may be employed within the spirit and scope of the present invention. Further, the tubular rod 20 may be constructed of a wide variety of materials such as plastic, metal, or any other suitable material.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A permanent wave roller for use in providing a permanent wave to hair comprising:

a rod having a predetermined length and an outer surface upon which an individual's hair is to be rolled to form a curl;

an elongated pressure element extending along said rod for applying pressure toward the outer surface of said rod for maintaining hair in a curl upon said rod; and a pad positioned between said elongated pressure element and hair positioned on the outer surface of said rod, said pad having a length extending substantially along the length of said rod and having a waffle-like shape with a plurality of rows of projecting pad portions spaced apart by a plurality of indentations extending along the length of said pad for enhancing the passage of a permanent solution to a curl and to prevent damage to an individual's hair.

2. A permanent wave roller according to claim 1, wherein said pressure element is an elastic cord having a first end removably affixed to one end of said rod and a second end removably affixed to a second end of said rod.

3. A permanent wave roller according to claim 1 wherein said pad is constructed from a sponge material.

4. A permanent wave roller according to claim 1, wherein said pad is substantially cylindrical in shape and encircles said pressure element.

5. A permanent wave roller according to claim 1, wherein said pad is constructed of rubber.

6. A permanent wave roller according to claim 1, wherein said pad is constructed of plastic foam.

7. A permanent wave roller according to claim 1, wherein said rod is a tubular element constructed of plastic.

8. A permanent wave roller according to claim 1, wherein said rod includes a central portion having a smaller diameter in relation to end portions of said rod, and further including a first attaching means for affixing a first end of said pressure element to a first end of said rod and a second attaching means for affixing a second end of said pressure element to a second end of said rod.

9. A permanent wave roller according to claim 8, wherein said first and second attaching means includes enlarged ends on said first and second ends of said pressure element and slots disposed in said first and second ends of said rod, wherein said slots permit said pressure element to pass therethrough and engage said enlarged ends to retain said pressure element relative to said rod.

10. A permanent wave roller according to claim 9, wherein said first attaching means further includes a stopper for insertion within a bore in said rod.

11. A permanent wave roller according to claim 1, wherein said rod includes a bore extending therethrough and a plurality of apertures extending through said rod and in communication with said bore.

12. A permanent wave roller according to claim 11, wherein said plurality of apertures are diamond shape for increasing the flow of permanent solution therethrough.

13. A permanent wave roller according to claim 10, and further including a slot disposed in said first end of said rod for retaining said pressure element relative to said rod when said stopper is inserted within said bore.

* * * * *